United States Patent [19]

Hosoya et al.

[11] Patent Number: 4,498,756

[45] Date of Patent: Feb. 12, 1985

[54] DEVELOPING DEVICE

[75] Inventors: Masahiro Hosoya, Yokohama; Tsuyoshi Ueno, Fujisawa, both of Japan

[73] Assignee: Tokyo Shibaura Denki Kabushiki Kaisha, Kawasaki, Japan

[21] Appl. No.: 363,933

[22] Filed: Mar. 31, 1982

[30] Foreign Application Priority Data

Apr. 7, 1981 [JP] Japan ..... 56-51048

[51] Int. Cl.[3] ..... G03G 15/08

[52] U.S. Cl. ..... 355/3 DD; 355/14 D

[58] Field of Search ..... 355/3 DD, 14 D, 3 R; 430/102, 103; 118/657; 95/1.7

[56] References Cited

U.S. PATENT DOCUMENTS

| | | | |
|---|---|---|---|
| 3,232,190 | 2/1966 | Willmott | 95/1.7 |
| 3,301,152 | 1/1967 | Mayo | 355/3 DD |
| 3,332,396 | 7/1967 | Gundlach | 355/3 DD X |
| 3,848,993 | 11/1974 | Hasiotis | 355/15 |
| 3,859,691 | 1/1975 | Katayama et al. | 118/651 X |
| 3,986,227 | 10/1976 | Fathergill et al. | 355/15 X |
| 3,992,091 | 11/1976 | Fisher | 355/15 |
| 4,034,709 | 7/1977 | Fraser et al. | 355/3 DD X |
| 4,084,899 | 4/1978 | Ishida et al. | 355/3 DD X |
| 4,158,498 | 6/1979 | Ohmori | 118/652 X |
| 4,194,830 | 3/1980 | Ohnuma et al. | 355/3 DD |
| 4,226,524 | 10/1980 | Hashimoto | 355/3 DD |
| 4,272,182 | 6/1981 | Abe et al. | 355/3 DD X |
| 4,292,387 | 9/1981 | Kanbe et al. | 355/3 DD X |
| 4,321,886 | 3/1982 | Azuma | 355/3 DD X |
| 4,331,757 | 5/1982 | Tanaka et al. | 355/3 DD X |
| 4,336,992 | 6/1982 | Szlucha et al. | 355/3 SH X |
| 4,373,798 | 2/1983 | Tsukada et al. | 355/3 DD |
| 4,386,577 | 6/1983 | Hosono et al. | 355/3 DD X |

FOREIGN PATENT DOCUMENTS

| | | |
|---|---|---|
| 54-42141 | 4/1979 | Japan . |
| 54-43027 | 4/1979 | Japan . |
| 54-43036 | 4/1979 | Japan . |
| 54-43037 | 4/1979 | Japan . |
| 54-43038 | 4/1979 | Japan . |

*Primary Examiner*—A. C. Prescott

*Attorney, Agent, or Firm*—Cushman, Darby & Cushman

[57] ABSTRACT

A developing device is provided for developing by means of a toner an electrostatic latent image formed on the surface of a photosensitive drum which rotates along one direction at a given speed. The developing device comprises a developing roller movably disposed at a given distance from the photosensitive drum, for causing the toner thereon to move in accordance with the movement thereof, whereby the toner thereon is supplied to the photosensitive drum by means of the surface potential of the electrostatic latent image, and a layer regulating member for regulating the amount of the toner put on the developing roller. The developing roller rotates in other direction at a speed relative to the given speed.

15 Claims, 5 Drawing Figures

DEVELOPING DEVICE

BACKGROUND OF THE INVENTION

The present invention relates to a developing device for supplying a developer to the surface of a photosensitive body on which an electrostatic latent image is to be formed and developing the electrostatic latent image, more specifically to a developing device disposed at a distance from the photosensitive body.

In a conventional device of a well-known type for developing an electrostatic latent image, developing means including a fur brush, cascade, magnetic brush, etc., are brought directly into contact with the surface of a photosensitive body. In such a developing device, a developer is supplied at random to the surface of the photosensitive body on which the electrostatic latent image is to be formed. Therefore, the developer cannot help sticking to that portion of the surface of the photosensitive body on which the electrostatic latent image is not formed (no-picture region) and which must be kept away from the developer, as well as to that portion on which the electrostatic latent image is formed (picture region). The developer sticking to the no-picture region, when fixed, would render a resultant copy image or picture foggy, thus exerting a bad influence upon the copy image quality.

Accordingly, there has recently been proposed a developing device in which a developing means, e.g., a developing roller, is separated from the surface of the photosensitive body, and the developer is supplied selectively to the picture region of the photosensitive body in accordance with the surface potential of the electrostatic latent image. According to the developing device of this type, the developer is not fed to the no-picture region, so that no fogging will be caused in the no-picture region to ensure satisfactory copy image quality.

In a copying apparatus with a non-contact type developing device, however, the photosensitive body and developing roller must be so designed as to move in the same direction at equal speeds in order to make the copy density microscopically. To this end, first, the moving speed of the photosensitive body is determined in proportion to the moving speed of the original (or the moving speed of an exposure lamp) on the basis of the specifications of the copying apparatus. On condition of the equality of speed, the moving speed of the developing roller is then determined. In the determination of the moving speed of the developing roller, therefore, it is impossible to take the developing characteristics into consideration, though it is essential to make an effort to maintain the developing characteristics in accordance with the previously determined moving speed of the developing roller. Thus, the developing device of the non-contact type is subject to difficulties in design and adjustment work, and is not suited for industrial use.

SUMMARY OF THE INVENTION

The present invention is contrived in consideration of these circumstances, and is intended to provide a developing device free from restrictions on design and adjustment work and adapted to industrial application, while maintaining the advantage of a non-contact type device.

According to an aspect of the present invention, there is provided a developing device for developing by means of a developer an electrostatic latent image formed of the surface of an image bearer moving on one direction at a given speed, comprises a moving member movably disposed at a given distance from the image bearer, for causing the developer thereon to move in accordance with the movement thereof, whereby the developer thereon is supplied to the image bearer by means of surface potential of the electrostatic latent image, and supply means for supplying the developer to the moving member, the moving member moves in a direction opposite the image bearer at a speed relative to the given speed, and the supply means includes a layer regulating member for regulating the amount of the developer put on the moving member.

DETAILED DESCRIPTION OF THE PREFERRED EMBODIMENTS

Referring now to the accompanying drawing of FIG. 1, there will be described in detail a developing device according to a first embodiment of the present invention which is applied to an electrostatic copying machine.

Figure 1:
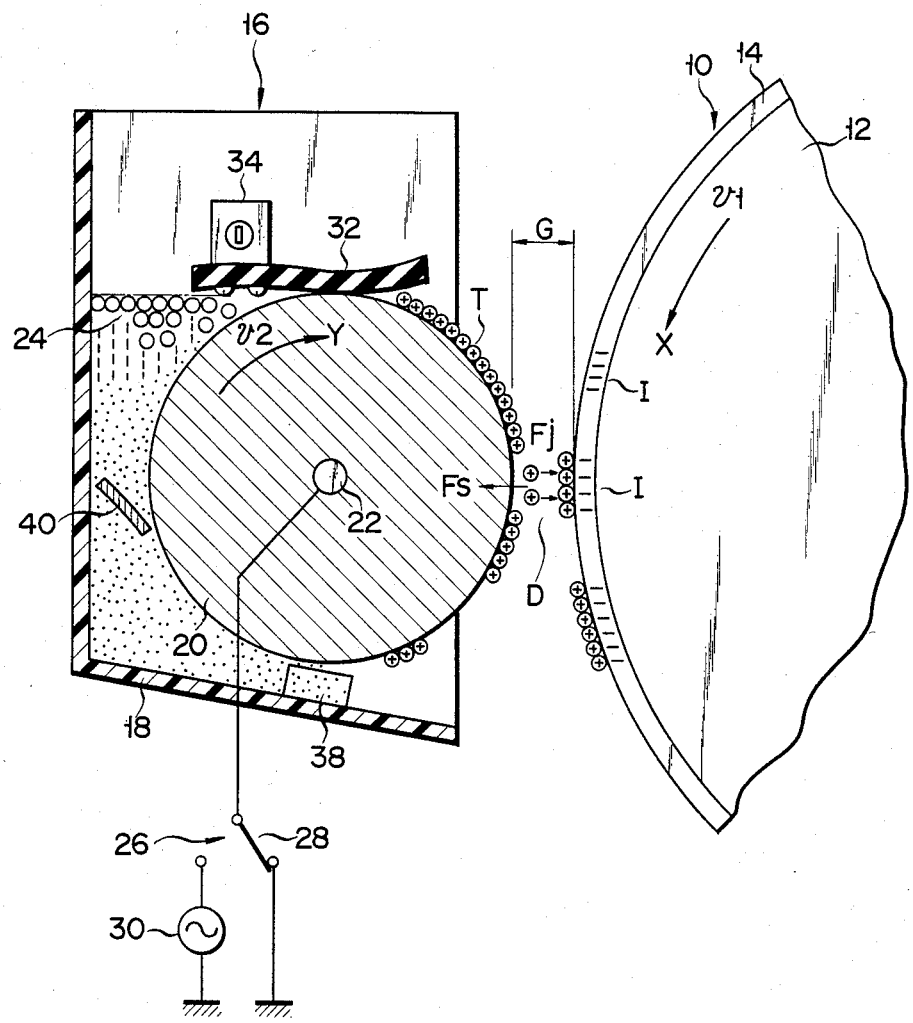
FIG. 1 is a sectional view schematically showing a developing device according to a first embodiment of the present invention.

In FIG. 1, numeral 10 designates a photosensitive drum as an image bearer on which an electrostatic latent image is to be formed. The photosensitive drum 10 includes a hollow, cylindrical drum body 12, and a photosensitive layer 14 laid on the whole outer peripheral surface of the drum body 12. The drum body 12 is formed of aluminum, and has a diameter of 78 mm and a thickness of 0.8 mm. The photosensitive layer 14 is formed by applying to the drum body 12 impalpable powder of resin dispersed in impalpable powder of zinc oxide. An electrostatic latent image I corresponding to a picture of the original and having a predetermined negative potential is formed on the surface of the photosensitive layer 14. The electrostatic latent image I is formed by, first, uniformly electrifying the photosensitive layer 14 by the well-known corona electric charging method and then exposing the photosensitive layer 14 to a light from a fluorescent tube reflected by the original. In the image exposure, a pattern corresponding to the image to be formed may be obtained directly from a cathode-ray tube, and a laser beam may be used for the reflected light. Further, the electrostatic latent image may be obtained not by the image exposure but by forming an electrostatic dot pattern on the photosensitive layer 14 with the aid of a needle-electrode.

The photosensitive drum 10 of the aforementioned construction is disposed inside the housing (not shown) of the electrostatic copying apparatus, and is driven by a driving mechanism (not shown) to rotate counterclockwise or in the direction of an arrow X of FIG. 1. The rotation speed of the drum 10 is so set that its circumferential speed v1 is 80 mm/sec. The surface potential of the electrostatic latent image is set to −500 V, and the drum body 12 is grounded.

A developing device 16 for developing the electrostatic latent image is disposed near the periphery of the photosensitive drum 10. The developing device 16 is provided with a plastic casing 18 open at one side to face the photosensitive drum 10. A developing roller 20 as a moving member is disposed inside the casing 18 so as to be rotatable about a shaft 22. The surface of the developing roller 20 is separated at a given distance G from the surface of the photosensitive drum 10. The distance G may range from 50 μm to 500 μm, and is set to 200 μm in this first embodiment. The developing roller 20 is driven by a driving mechanism (not shown) to rotate clockwise or in the direction of an arrow Y opposite to the rotating direction of the photosensitive drum 10. The rotation speed of the developing roller 20 is so set that its circumferential speed v2 is different from that of the photosensitive drum 10. In this first embodiment, the rotation speed of the developing roller 20 is so set that its circumferential speed v2 is higher than the circumferential speed v1 of the photosensitive drum 10. Where the circumferential speed v1 is 80 mm/sec, the circumferential speed v2 has a maximum at 150 mm/sec, and is set to 100 mm/sec in this first embodiment.

The developing roller 20 is formed of aluminum, i.e., non-magnetizable, and has a diameter of 25 mm. The outer peripheral surface of the developing roller 20 is satin finished. By this satin finish, pits of a depth substantially equivalent to the particle diameter of a developer 24, as mentioned later, are formed in the outer peripheral surface of the developing roller 20. The depth of the pits may be several times as large as the particle diameter of the developer 24.

The developing roller 20 is connected with a bias voltage control mechanism 26. The control mechanism 26 is provided with a changeover switch 28 and an AC power source 30. A first contact of the changeover switch 28 is connected with the developing roller 20, a second contact is directly grounded, and a third contact is grounded through the AC power source 30. In the changeover switch 28, the first and second contacts are connected in a first mode, and the first and third contacts are connected in a second mode. In this first embodiment, the control mechanism 26 is set in the first mode.

A rubber blade 32 as a layer regulating member is laid on the outer peripheral surface of the developing roller 20. The rubber blade 32 has a hardness of 60 to 70 and a resistance of $10^{10}$ Ω·cm to $10^{16}$ Ω·cm. The proximal end portion of the rubber blade 32 is fixed to the casing 18 by means of a holder 34, and the middle portion is pressed against the outer peripheral surface of the developing roller 20 with a nip width of 2 mm. The layer of the developer 24 formed on the outer peripheral surface of the developing roller 20 is thinned when the pressing force of the rubber blade 32 is augmented, and is thickened when the force is attenuated. In this first embodiment, the pressing force is set to 700 g/cm$^2$, and the thickness of the layer under such pressing force is substantially equal to the particle diameter of the developer 24.

Inside the casing 18, toner as the developing agent or developer 24 is stored on the upper-stream side of the rubber blade 32 with respect to the rotating direction of the developing roller 20. The toner 24 has a particle diameter of 12 μm to 15 μm and a resistance of $10^{12}$ Ω·cm to $10^{14}$ Ω·cm. The toner 24 is formed of nonmagnetic, one-component toner prepared by mixing carbon with styleneacrylate resin.

On the bottom of the casing 18, a seal member 38 is located under the developing roller 20. The seal member 38 is formed of urethane, and is intended to prevent the toner 24 from leaking from the casing 18 to the outside. Inside the casing 18, a scraping member 40 is disposed on the down-stream side of the seal member 38 with respect to the rotating direction of the developing roller 20, with one end pressed against the surface of the developing roller 20. The other end of the scraping member 40 is fixed to the casing 18. The scraping member 40 is formed of phosphor bronze, and is intended to scrape off the toner 24 not having played a part in the developing operation and remaining on the surface of the developing roller 20. By the use of the scraping member 40, the photosensitive layer 14 of the photosensitive drum 10 is always supplied with fresh toner 24.

The space between the photosensitive drum 10 and the developing roller 20 is defined as a developing region D.

There will now be described the operation of the developing device 16 constructed in the above-mentioned manner.

First, an electrostatic latent image I corresponding to a picture of the original is formed on the surface of the photosensitive layer 14 by a well-known method. The surface potential of the electrostatic latent image I is set to −500 V, and the negatively charged portion of the photosensitive layer 14 is defined as a picture region to which the toner 24 will stick. The electrostatic latent image I comes into the developing region D in the counterclockwise direction of the arrow X at the circumferential speed v1, accompanying the rotation of the photosensitive drum 10.

As for the developing roller 20, it rotates in the clockwise direction of the arrow Y. Sticking to the surface of the developing roller 20, the toner 24 moves toward the developing region D as the roller 20 rotates. In the developing region D, the surface of the developing roller 20 and the surface of the photosensitive drum 10 move in the same direction, though the developing roller 20 and the photosensitive drum 10 rotates in the opposite directions. By such movement, the toner 24 passes between the rubber blade 32 and the developing roller 20. Hereupon, the toner 24 is frictionally charged by the physical contact between the toner 24 and the developing roller 20. Since the electrostatic latent image has a negative potential, the toner used is expected to obtain positive charges through the frictional electric charging.

Thus, a thin layer T (of a thickness substantially equal to the particle diameter of the toner 24) of the positively charged toner 24 is electrostatically adsorbed and formed on that portion of the surface of the developing roller 20 through which the rubber blade 32 has passed. The thin toner layer T enters the developing region D at the circumferential speed v2, accompanying the rotation of the developing roller 20.

In the developing region D, the electrostatic latent image I faces the thin layer T of the toner 24. Accordingly, the toner 24 is attracted to the side of the photosensitive drum 10 by the negative charges constituting the electrostatic latent image I, and finally flies away from the developing roller 20 to reach the photosensitive layer 14. Namely, the positively charged toner 24 is subjected to a Coulomb's force Fs acting between the toner 24 and the developing roller 20 to cause the toner 24 to be attracted to the developing roller 20, and a Coulomb's force Fj acting between the toner 24 and the photosensitive drum 10 to cause the toner 24 to be attracted to the photosensitive drum 10. Since Fs is smaller than Fj in the developing region D, the toner 24 flies away toward the photosensitive drum 10 and sticks to the picture region.

At this time, while the developing roller 20 is rotating at a circumferential speed higher than that of the photosensitive drum 10, the toner 24 supplied from the developing roller 20 to the photosensitive drum 10 is restricted to a predetermined amount by the rubber blade 32 as the layer regulating member. Even though the developing roller 20 rotates at a higher circumferential speed than the photosensitive drum 10 does, therefore, the toner 24 will never excessively be supplied to the photosensitive drum 10, so that the quality of copy image will be maintained satisfactory. Thus, according to the first embodiment, the circumferential speed v2 of the developing roller 20 need not be coincident with the circumferential speed v1 of the photosensitive drum 10, and can be set freely, unlike the case of the prior art device. Accordingly, this first embodiment is free from the various conventional restrictions on design and adjustment work, and yet, maintains the advantage of the prior art device to obtain less foggy copy images of high quality. Since the control mechanism 26 is set in the first mode, the fogginess of the images obtained can be further lessened.

Thus, the toner 24 on the developing roller 20 which has not played a part in the development in the developing region D leaves the developing region D as the developing roller 20 rotates, passes by the seal member 38, and reaches a position to face the scraping member 40. Then, the toner 24 remaining on the developing roller 20 is scraped off from the developing roller 20 by the scraping member 40. Uncharged toner newly sticks to that portion of the surface of the developing roller 20 from which the remaining toner 24 is scraped off. Thus, a series of developing processes is completed.

Although in the first embodiment the control mechanism 26 is set in the first mode, it may alternatively be set in the second mode. If the control mechanism 26 is set in the second mode, then an AC bias voltage will be applied to the developing roller 20. The impression of the AC bias voltage produces some fog, which will not, however, exert any bad influence upon the essential quality of image. After all, the flying efficiency of the toner 24 is greatly improved, so that the distance G can be widened. Further, the power source for the control mechanism 26 may be a DC power source or a combination of both AC and DC power sources.

The present invention is not limited to the above-mentioned first embodiment, and various changes and modifications may be effected therein by one skilled in the art without departing from the scope or spirit of the invention. Alternative embodiments of the invention will now be described in detail. In the description to follow, like portions as in the first embodiment are designated by like reference numerals.

Figure 2:
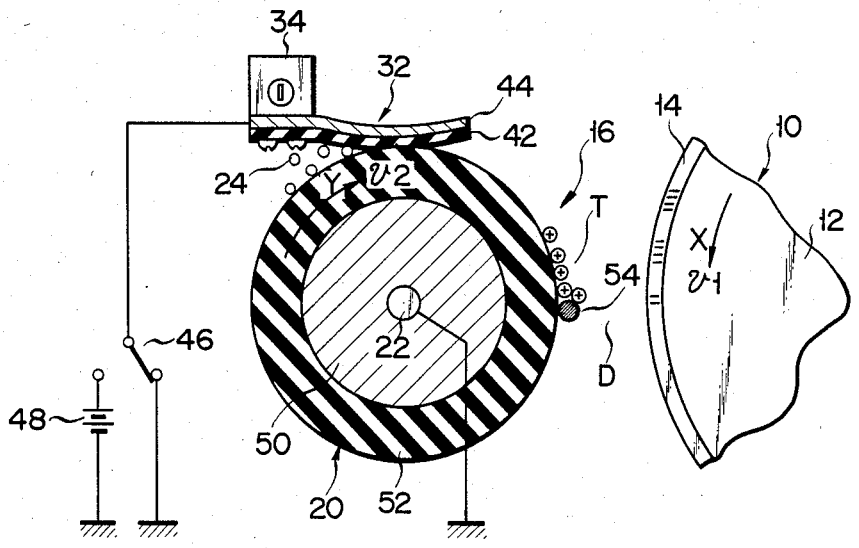
FIG. 2 is a sectional view schematically showing a developing device according to a second embodiment of the invention.

FIG. 2 shows a second embodiment of the present invention. In this second embodiment, the layer regulating member 32 of the developing device 16 is composed of a conductive rubber blade 42 and an aluminum electrode 44 attached to the top surface of the conductive rubber blade 42. The electrode 44 is connected with the anode of a DC power source 48 through one terminal of a changeover switch 46. The other terminal of the changeover switch 46 is grounded. As for the developing roller 20, it includes a metal core 50 and a conductive rubber 52 covering the outer peripheral surface of the core 50. The core 50 is grounded. Further, a separating wire 54 is disposed in contact with that portion of the surface of the developing roller 20 which is located within the developing region D.

In the developing device 16 of the aforementioned construction, a DC voltage is applied from the DC power source 48 to the electrode 44 through the changeover switch 46. Accordingly, the toner 24 passing between the rubber blade 42 and the developing roller 20 accompanying the rotation of the developing roller 20 is forced to be charged, thereby obtaining positive charges. Hereupon, the surface of the developing roller 20 is formed of the rubber 52, so that no substantial pressing force will act on the toner 24 as the toner 24 is held between the developing roller 20 and the rubber blade 42. Moreover, the toner 24 charged in the developing region D is coercively separated from the surface of the developing roller 20 by the separating wire 54. By the use of the separating wire 54, therefore, the flying efficiency can be increased mechanically with simple arrangement instead of electrically improving it by means of the bias voltage control mechanism 26. With such arrangement of the second embodiment of the developing device 16, the toner 24 can be charged with improved reliability, and the same effect of the first embodiment can be obtained.

Figure 3:
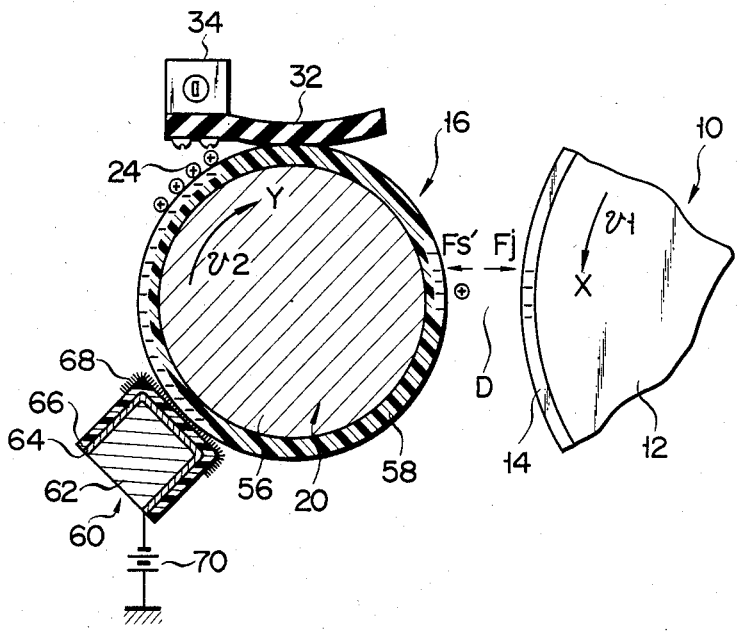
FIG. 3 is a sectional view schematically showing a developing device according to a third embodiment of the invention.

FIG. 3 shows a third embodiment of the present invention. In this third embodiment, the developing roller 20 includes a metal roller body 56 and a dielectric layer 58 of Mylar or Teflon (trade name) covering the whole outer peripheral surface of the roller body 56. In this third embodiment, moreover, the developing device 16 includes a charger 60 to charge the surface of the developing roller 20. The charger 60 is of a contact type, and includes a main body 62, a conductive layer 64 of carbon paper put on the surface of the main body 62, and a number of conductive furs 68 planted on the conductive layer 64 by means of a conductive adhesive agent 66. The conductive furs 68 are formed of REC-A (trade name), for example. The conductive layer 64 is connected with the cathode of a DC power source 70. The anode of the DC power source 70 is grounded.

In the developing device 16 of the aforementioned construction, a negative voltage is applied from the power source 70 to the charger 60, whereby the dielectric layer 58 of the developing roller 20 is charged negatively. Then, the toner 24 charged through the blade 32 is adsorbed on the surface of the developing roller 20 with a greater electrostatic adsorptive force, as compared with the cases of the first and second embodiments. Namely, in this third embodiment, a Coulomb's force Fs' to cause the toner 24 to be attracted to the developing roller 20 is greater than its corresponding Coulomb's force Fs for the first embodiment. Thus, it is possible to control the energy required to separate the toner 24 from the developing roller 20. As in the aforesaid case of DC bias voltage, therefore, fogging can be more prevented.

Figure 4:
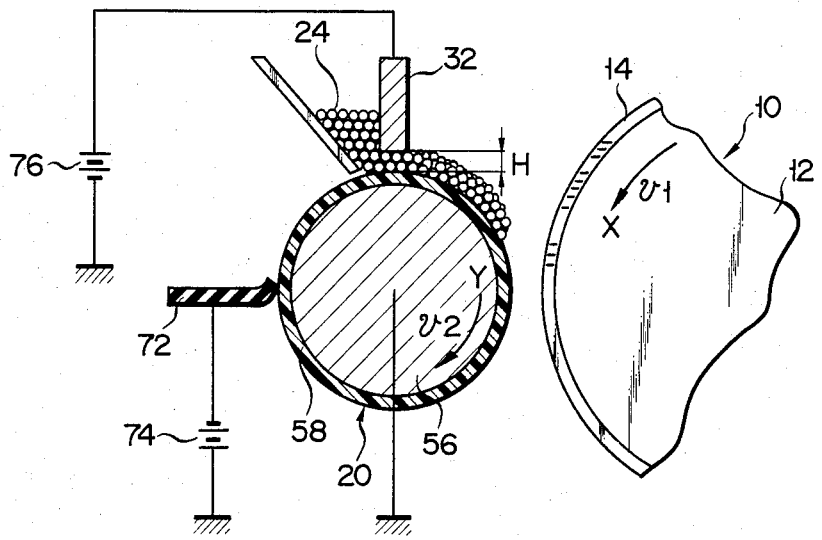
FIG. 4 is a sectional view schematically showing a developing device according to a fourth embodiment of the invention.
Figure 5:
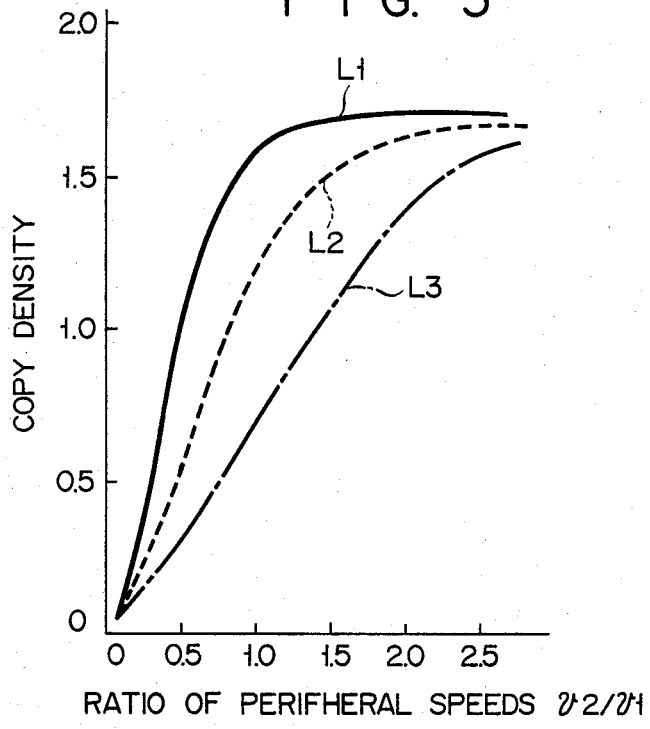
FIG. 5 is a diagram showing the relationships between the copy density and speed ratio in the developing device shown in FIG. 4 with the distance between a developing roller and a doctor blade used as a parameter.

FIGS. 4 and 5 show a fourth embodiment of the present invention. In this fourth embodiment, the circumferential speed v2 of the developing roller 20 is lower than the circumferential speed v1 of the photosensitive drum 10. Where the circumferential speed v1 is 80 mm/sec, the circumferential speed v2 has its minimum at 20 mm/sec, and is set to 50 mm/sec in this fourth embodiment. The developing roller 20 includes a metal roller body 56 and a dielectric layer 58 of Mylar or Teflon (trade name) covering the whole outer peripheral surface of the roller body 56. The roller body 56 is grounded. A blade 72 for charging the dielectric layer 58 of the developing roller 20 is disposed in contact with the dielectric layer 58 or the outer peripheral surface of the developing roller 20. The blade 72 is formed of conductive rubber with a resistance of $10^2\Omega\cdot$cm, and is supplied with a voltage of $-500$ V from a DC power source 74.

A doctor blade as the layer regulating member 32 is disposed at a given distance H from the surface of the developing roller 20. The distance H depends on the ratio of the circumferential speed v2 of the developing roller 20 to the circumferential speed v1 of the photosensitive drum 10, i.e., v2/v1. Where the toner 24 used has a low resistance (approx. $10^{11}\Omega\cdot$cm), the distance H ranges from 100 $\mu$m to 400 $\mu$m, and is set to 200 $\mu$m in this fourth embodiment. Namely, the copy density varies according to the speed ratio v2/v1 with the distance H as a parameter, as shown in FIG. 5. In the graph of FIG. 5, lines L1, L2 and L3 represent cases where the distance H is 300 $\mu$m, 100 $\mu$m and 50 $\mu$m, respectively.

The doctor blade 32 is connected with the anode of a DC power source 76. The cathode of the DC power source 76 is grounded. The voltage of the DC power source 76 may range from 100 V to 1 kV, and is set to 200 V in this fourth embodiment. Since the doctor blade 32 is thus connected with the power source 76, the toner 24 passing between the doctor blade 32 and the developing roller 20 accompanying the rotation of the roller 20 is forced to be charged.

With such arrangement of the fourth embodiment, even though the circumferential speed v2 of the developing roller 20 is lower than the circumferential speed v1 of the photosensitive drum 10, it will be possible to obtain less foggy, satisfactory copy images.

What we claim is:

1. Apparatus for forming a visible image on the surface of an image bearer rotating in one direction at a given speed, said visible image corresponding to an electrostatic latent image on said surface, comprising:

non-magnetic toner;

a non-magnetized developing roll disposed at a position where any layer of said non-magnetic toner disposed on the outer circumferential surface of said developing roll does not contact the surface of said image bearer, said developing roll rotating in a direction opposite to said one direction, a developing area being defined between said outer circumferential surface of said developing roll and said surface of said image bearer;

toner hopper means for containing said non-magnetic toner and for causing said non-magnetic toner in said hopper to touch that part of said outer circumferential surface of said developing roll which is disposed between a first position and a second position located in the rotation direction of said developing roll from said first position between said first position and said developing area; and regulating means, provided adjacent to said developing roll at said second position, for pressing that non-magnetic toner on said developing roll which passes through a gap between said regulating member and said developing roll, and charging said passed non-magnetic toner by slide-contacting said passed non-magnetic toner with said developing roll, so that said charged non-magnetic toner may be attracted to said developing roll by its charges and transferred to said developing area by rotation of said developing roll, and said non-magnetic toner which has passed through the gap forming a thin layer on that part of said developing roll which is located between said second position and said developing area.

2. The developing device according to claim 1, wherein said developing roll rotates faster than said image bearer, and said regulating means includes an elastic member in contact with said developing roll under a given pressing force.

3. The developing device according to claim 2, wherein said developing roll is formed of a conductive material and grounded, and said regulating means is formed of conductive rubber.

4. The developing device according to claim 2, further comprising an AC power source having a given voltage, said developing roll being formed of a conductive material and being connected to said AC power source, said regulating means being formed of conductive rubber.

5. The developing device according to claim 2, wherein said developing roll has a satin finished surface facing said image bearer.

6. The developing device according to claim 2, wherein said developing roll includes a metal core and a first layer of conductive rubber on the surface of said core, said core being grounded, and said regulating means includes a second layer of conductive rubber and an electrode thereon, said second layer being in contact with said first layer.

7. The developing device according to claim 6, further comprising a separating wire fixedly disposed in contact with that portion of said first layer which faces said image bearer, whereby said toner located on that portion of said first layer which faces said image bearer is coercively separated from said first layer as said developing roll rotates.

8. The developing device according to claim 6, wherein said electrode is grounded.

9. The developing device according to claim 6, further comprising a DC power source having a given voltage, said electrode being connected with said DC power source.

10. The developing device according to claim 2, wherein said developing roll includes a metal core and a third layer of a dielectric on the surface of said core, and said regulating means is formed of conductive rubber.

11. The developing device according to claim 10, further comprising means for charging said third layer.

12. The developing device according to claim 1, wherein said rotating means rotates more slowly than said image bearer, and said regulating means is disposed at a given distance from said developing roll.

13. The developing device according to claim 12, wherein said rotating means includes a metal core and a fourth layer of a dielectric on the surface of said core, said core being grounded, and said regulating means is formed of a conductive material.

14. The developing device according to claim 13, further comprising a DC power source having a given voltage and connected with said regulating means, and means for charging said fourth layer.

15. The developing device according to claim 1, further comprising a blade provided in said toner hopper means in contact with that portion of said developing roll located between said first position and said second position, said blade being disposed to scrape charged toner attached to said developing roll as said developing roll rotates.

* * * * *